United States Patent [19]

Masham

[11] Patent Number: 4,570,570

[45] Date of Patent: Feb. 18, 1986

[54] MIXING DEVICE FOR PARTICULATE MATERIAL

[75] Inventor: Roger D. Masham, Ashwell, England

[73] Assignee: Xerox Corporation, Stamford, Conn.

[21] Appl. No.: 613,681

[22] Filed: May 24, 1984

[30] Foreign Application Priority Data

Jun. 8, 1983 [GB] United Kingdom ..... 8315725

[51] Int. Cl.[4] ..... B05C 11/00

[52] U.S. Cl. ..... 118/612; 118/644; 118/658; 366/337

[58] Field of Search ..... 118/602, 612, 653, 657, 118/658, 644; 355/3 DD, 14 D; 366/181, 337

[56] References Cited

U.S. PATENT DOCUMENTS

| | | | |
|---|---|---|---|
| 3,697,050 | 10/1972 | Stanley | 118/658 |
| 3,707,047 | 1/1973 | Reichart, Jr. | 118/658 |
| 4,025,179 | 5/1977 | Hudson | 355/3 DD |
| 4,075,977 | 2/1978 | Williams | 118/658 |

*Primary Examiner*—Norman Morgenstern

*Assistant Examiner*—Ken Jaconetty

*Attorney, Agent, or Firm*—H. Fleischer; J. E. Bock; R. Zibelli

[57] ABSTRACT

An apparatus in which flowing developer material is mixed. A plurality of spaced vanes project outwardly from a dividing plate to define a plurality of sets of chambers arranged in substantially parallel rows. Each chamber is arranged to receive developer material at an entrance aperture and to release the developer material from an exit aperture with the exit aperture being displaced from a position vertically below its entrance aperture. Each row has an alternate series of chambers with their exit apertures spaced respectively to the left and right of the position vertically below their entrance apertures. The entrance apertures and exit apertures of the chambers of different rows are aligned so that on successive recirculations of the developer material, the developer material moves simultaneously from left to right and from row to row, and from right to left and from row to row.

8 Claims, 9 Drawing Figures

REAR

MIDDLE

FRONT

MIXING DEVICE FOR PARTICULATE MATERIAL

This invention relates generally to an electrophotographic printing machine, and more particularly to a development system employed therein.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of at least carrier granules and toner particles. The toner particles adhere triboelectrically to the carrier granules. This mixture is brought into contact with the latent image. Toner particles are attracted from the carrier granules to the latent image forming a toner powder image thereon. The development system transports an excess of developer material to the latent image. The unused developer material and denuded carrier granules, i.e. carrier granules without toner particles, are returned to the sump of the developer housing for subsequent reuse. Mixing of the unused developer material and denuded carrier granules with new toner particles is achieved by a crossmixing device. Hereinbefore, crossmixing devices employed two parallel rows of chambers, in the form of chutes, with all the chutes in one row displacing material to the left, and all the chutes in the other row displacing material to the right. Although such a crossmixer provides good mixing characteristics, it is desirable, in certain applications, to achieve even more thorough mixing. Furthermore, crossmixing devices of this kind tend to be sensitive to tilt of the apparatus, as well as to any imbalances in the amount of developer material falling in the two rows of chutes. Either of these tendencies produces a pumping action which causes a large proportion of the developer material to accumulate at one end of the apparatus, with corresponding depletion at the other end.

Various approaches have been devised to improve mixing of developer material. The following disclosures appear to be relevant.

U.S. Pat. No. 3,697,050
Patentee: Stanley
Issued: Oct. 10, 1972

U.S. Pat. No. 3,707,947
Patentee Reichart, Jr.
Issued: Jan. 2, 1973

U.S. Pat. No. 4,025,179
Patentee: Hudson
Issued: May 24, 1977

The relevant portions of the foregoing disclosures may be briefly summarized as follows:

Stanley describes a crossmixer wherein developer material cascades through a baffle on either side of a wall. The material, which falls through the baffle by virtue of the deflectors on the front side of the wall, moves in successive steps from right to left. The material, which falls between the wall and end wall, is guided by the deflectors from left to right.

Reichart, Jr. discloses a cross-channel mixer having two banks of channels. The channels in one bank are slanted in one direction with the channels in the other bank slanted in the opposite direction. Developer material entering the crossmixer cyclically walks back and forth so as to be thoroughly mixed.

Hudson describes a passive crossmixing system employing a plate having a plurality of progressively shorter chutes disposed symmetrically about the central region thereof. The developer material falls through the chutes with the material in the central region having a greater velocity than the material in the marginal regions.

Pursuant to the features of the present invention, there is provided an apparatus for mixing flowing developer material. The apparatus includes a plurality of spaced vanes projecting outwardly from a dividing plate to define a plurality of sets of chambers arranged in substantially parallel rows. Each chamber is arranged to receive developer material at an entrance aperture and to release developer material from an exit aperture. The exit aperture of each chamber is displaced from a position vertically below its entrance aperture. Each row has an alternate series of chambers with their exit apertures spaced respectively to the left and right of the position vertically below their entrance apertures. The entrance apertures and exit apertures of the chambers of different rows are aligned so that on successive recirculations of the developer material, the developer material moves simultaneously from left to right and from row to row, and from right to left and from row to row.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
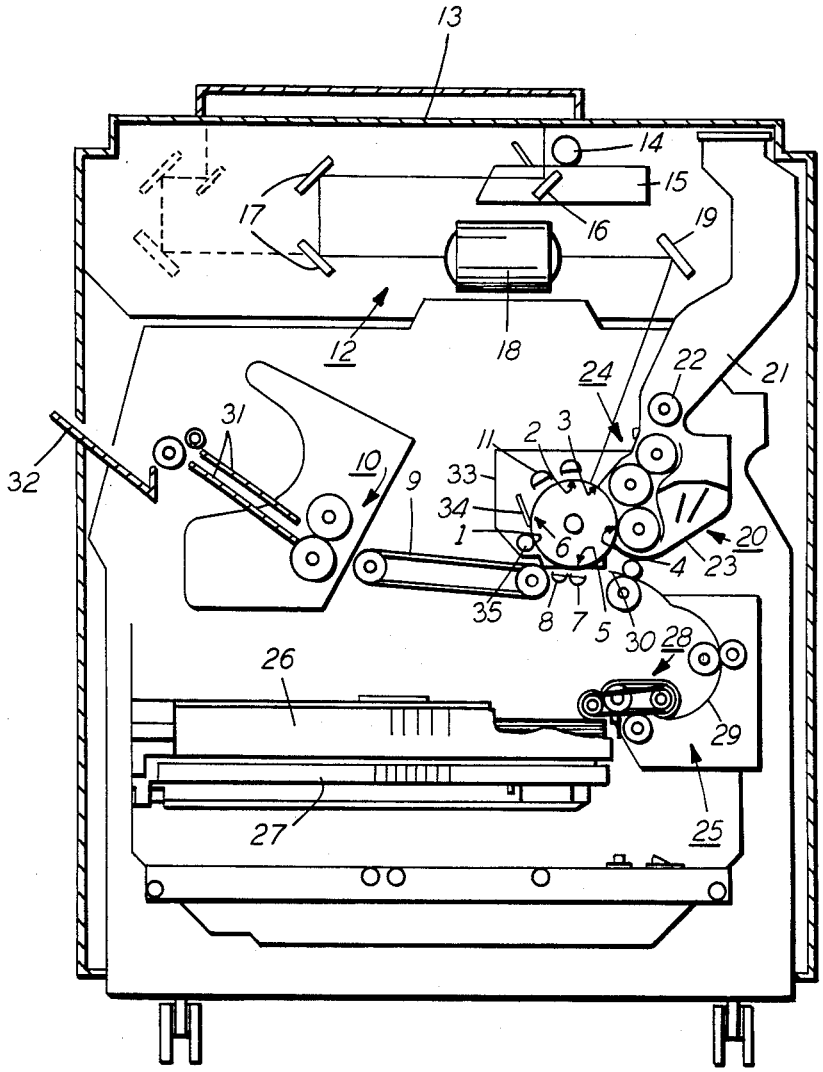
FIG. 1 is a schematic, elevational view of an electrophotographic printing machine incorporating the features of the present invention therein.

Referring now to FIG. 1, there is shown an illustrative electrophotographic printing machine having a drum 1 mounted for rotation (in the clockwise direction as viewed in FIG. 1) to advance the photoconductive surface thereof sequentially through a series of processing stations: a charging station 2; an imaging station 3; a development station 4; a transfer station 5; and a cleaning station 6.

Charging station 2 has a corona generating device which deposits a uniform electrostatic charge on the photoconductive surface. A document to be reproduced is positioned on a platen 13 and scanned by means of a moving optical scanning system to produce a flowing light image on drum 1 at 3. The optical image selectively discharges the photoconductive surface in image configuration, whereby an electrostatic latent image of the document is recorded on the photoconductive surface. At development station 4, the electrostatic latent image is developed into visible form by bringing toner particles into contact therewith. The toner particles are deposited on the charged areas of the photoconductive surface. Cut sheets of paper are moved to transfer station 5 in synchronous relation with the developed image on the photoconductive surface. The developed image is transferred to the copy sheet thereat. A transfer corona generating device 7 generates an electric field to assist in the transfer of the toner particles to the copy sheet. The copy sheet is then stripped from drum 1. Detachment of the copy sheet from the drum is assisted by an electric field generated by a detack corona generating device 8. The copy sheet having the developed image thereon is then advanced by transport belt system 9 to fusing station 10.

After transfer of the developed image from the photoconductive surface, some toner particles usually remain thereon. These particles are removed thereform at cleaning station 6. After cleaning, any electrostatic charges remaining on the photoconductive surface are removed by an erase corona generating device 11. The photoconductive surface is then ready to be charged again by charging corona generating device 2, as the first step in the next copy cycle.

The optical image at imaging station 3 is formed by optical system 12. A document (not shown) to be copied is placed on platen 13, and is illuminated by a lamp 14 that is mounted on a scanning carriage 15 which also carries a mirror 16. Mirror 16 is a full-rate scanning mirror of a full and half-rate scanning system. Full-rate mirror 16 reflects an image of a strip of the document to be copied onto the half-rate scanning mirror 17. The image is focused by a lens 18 onto drum 1, being deflected by a fixed mirror 19. In operation, full-rate mirror 16 and lamp 14 are moved across the machine at a constant speed, while at the same time half-rate mirrors 17 are moved in the same direction at half that speed. At the end of a scan, the mirrors are in the position shown in a broken outline at the left-hand side of FIG. 1. These movements of the mirrors maintain a constant optical path length so as to maintain the image on the photoconductive surface in sharp focus throughout the scan.

At development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and toner. The developer material is brought into contact with drum 1 by a three-roll magnetic brush developing system 24.

The developed image is transferred, at transfer station 5, from the photoconductive surface to a sheet of copy paper (not shown) which is delivered into contact therewith by paper supply system 25. Paper copy sheets are stored in two paper trays, an upper, main tray 26 and a lower, auxiliary tray 27. The top sheet of paper in either one of the trays is moved, as required, into feeding engagement with a common fixed position, sheet feeder 28. Sheet feeder 28 advances sheets around curved guide 29 for registration at a registration point 30. Once registered, the sheet is moved into contact with the photoconductive surface in synchronous relation to the image so as to receive the image at transfer station 5.

The copy sheet carrying the transferred image is transported by means of vacuum transport belt 9 to heated roll fuser 10. The image is fixed to the copy sheet by the heat and pressure in the nip between the two rolls of the fuser. The final copy is fed by the fuser rollers along output guides 31 into catch tray 32.

After transfer of the developed image from the photoconductive surface to the copy sheet, the photoconductive surface is cleaned at cleaning station 6. At the cleaning station a housing 33 forms with the drum 1 an enclosed cavity having a doctor blade 34 mounted therein. Doctor blade 34 scrapes residual toner particles off the photoconductive surface. The scraped particles fall to the bottom of the housing. Auger 35 transports the particles from the housing.

Figure 2:
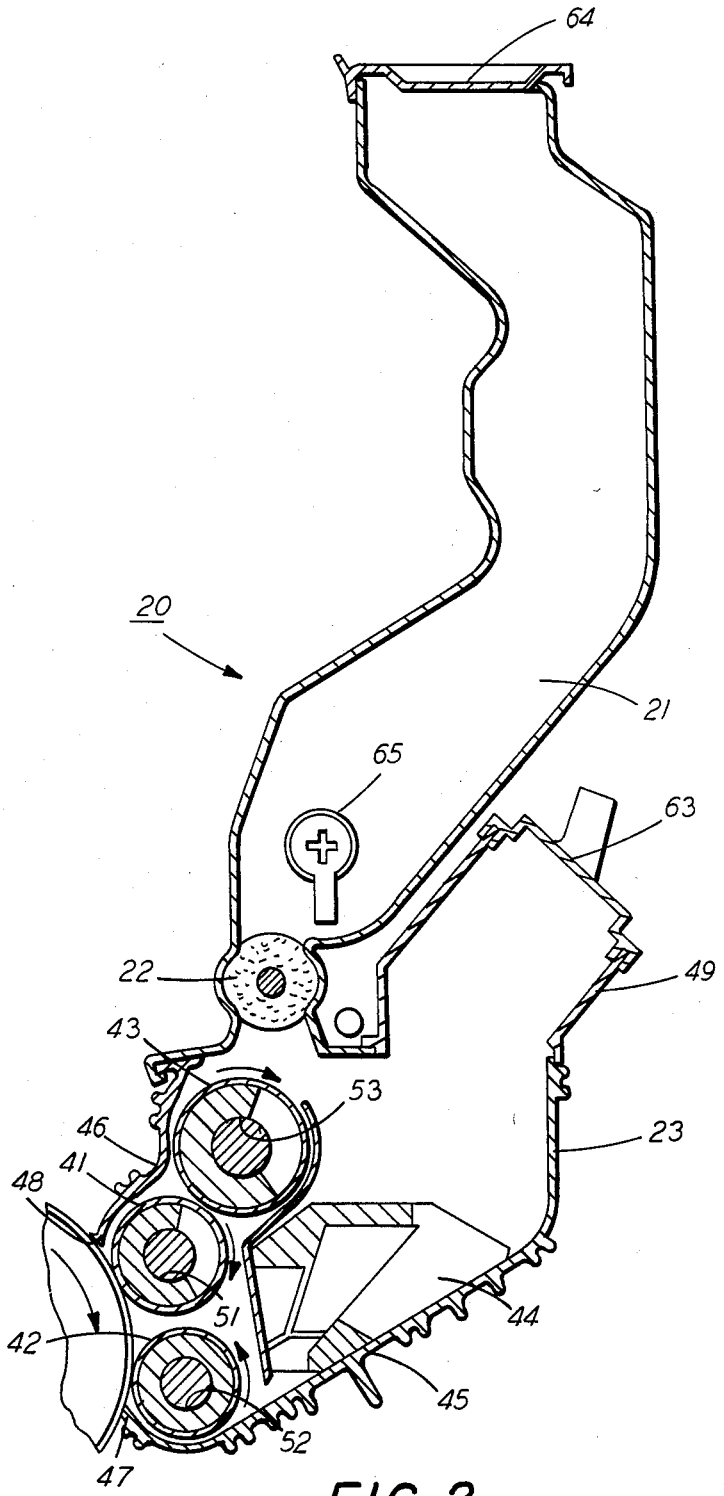
FIG. 2 is a sectional, elevational view of the magnetic brush development apparatus of the FIG. 1 printing machine.
Figure 3:
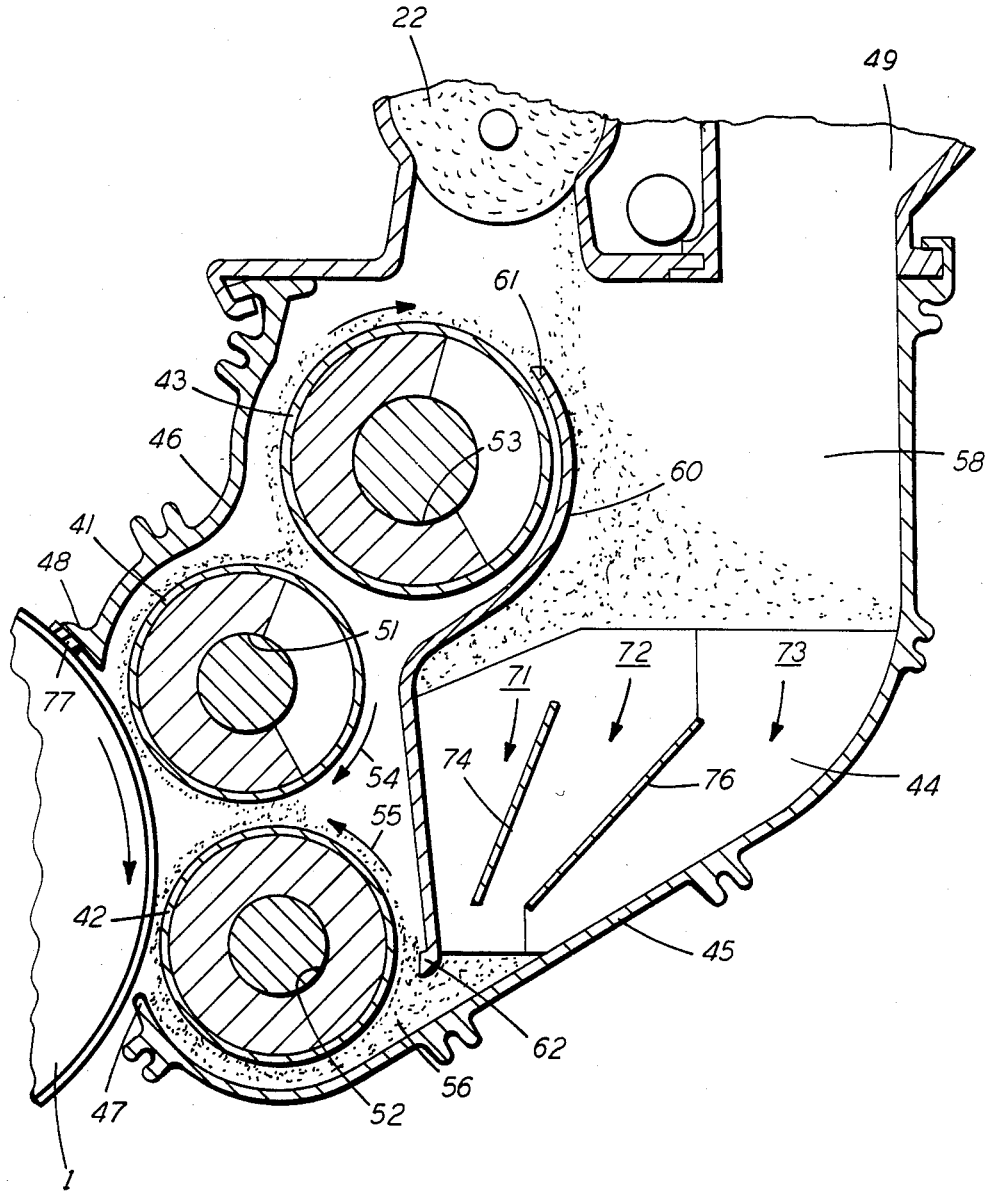
FIG. 3 is an enlarged fragmentary, sectional, elevational view of a portion of the FIG. 2 development apparatus.

Referring now to FIGS. 2 and 3, development system 20 has upper and lower development rolls 41 and 42, a single transport roll 43, and a crossmixer 44. The developer mixture includes magnetizable carrier particles and toner particles. The carrier particles are recirculated within the developer housing 23 with the toner particles, some of which are consumed during development, being replenished from a supply contained in toner hopper 21 by rotating foam roller 22.

Developer housing 23 has a lower extrusion 45 and an upper extrusion 46. The left-hand extremity 47 of the lower extrusion 45, as viewed in FIG. 2, and the lower extremity 48 of the front extrusion 46 define an opening adjacent drum 1. Extrusions 45 and 46 are mounted between end plates (not shown) at the front and rear of the machine with the entire assembly forming a substantially sealed chamber. The chamber is closed at the top by toner hopper 21 and by negative pressure chamber housing 49.

Mounted within housing 23 are the three magnetic brush rollers 41, 42 and 43. Rolls 41 and 42 are the developer rolls, and roll 43, above the upper developer roll 41, is a transport roll. Rolls 41, 42 and 43 are flow formed, of extruded aluminum or aluminum alloy, tubes surrounding fixed multi-pole rubber magnets 51, 52 and 53, respectively. The magnets are held in position by flats on their respective spindles about which rolls 41, 42 and 43 rotate on their respective bearings in the end caps.

The operation of the three-roll development system will now be described in more detail with reference to FIG. 3. Upper developer roll 41 and lower developer roll 42 are mounted for rotation in opposite directions, as indicated by arrows 54 and 55. Developer material is picked up by the lower developer roll 42 in region 56 located near the bottom of the housing 23 adjacent the bottom of crossmixer 44. As indicated by the arrows in FIG. 3, developer material is carried upwards, on the portion of lower developer roll 42 which is furthest from drum 1, into the gap between lower developer roll 42 and upper developer roll 41. Upper developer roll 41 is rotating in the opposite direction to lower developer roll 42, so the top of the lower roll and the bottom of the upper roll are moving in the same direction, i.e. towards drum 1. The magnetic poles within stationary magnets 51 and 52 are arranged to cause splitting of the stream of developer material into substantially equal streams, one of which is carried upwards against the photoconductive surface by the upper developer roll 41, and the other of which is carried downwards thereagainst by the lower developer roll 42. During passage of the developer material over the photoconductive surface adjacent both developer rolls, development of the electrostatic latent image takes place by the deposition of some of the toner particles thereon. The developer material on the lower developer roll 42, after developing the latent image on the photoreceptor, is carried down to the bottom of housing 23, and back into region 56. There, the unused developer material joins and mixes with developer material falling from the bottom of crossmixer 44. Developer material on upper developer roll 41, after developing the latent image, is carried upwards toward transport roll 43. Transport roll 43 is mounted for rotation in the same rotational sense as upper developer roll 41. The magnetic poles in magnet 51 of upper developer roll 41 are such that the magnetic field substantially disappears in the nip between the upper developer roll 41 and the transport roll 43. This prevents developer material from entering the nip between the two rolls. Transport roll 43 carries developer material upwardly, away from drum 1, and towards the rear of housing 23. The magnetic field of magnet 53 in transport roll 43 substantially disappears just beyond the top of the transport roll 43. The developer material leaving the transport roll falls into reservoir 58 of developer material which fills crossmixer 44 at all times. A valance 60 divides the region of housing 23 containing the magnetic brush rolls from the region containing the crossmixer 44. The upper edge 61 of the valance assists in deflecting developer material into the reservoir 58 of developer material. The lower edge 62 of the valance defines a feed gap adjacent lower developer roll 42 through which passes developer material picked up by lower developer roll 42 from region 56.

As indicated in a general way in FIG. 3 by the dots representing developer material and by the accompanying arrows, the developer material is circulated around the developer housing to contact the photoconductive surface at two separate places. The first development takes place adjacent the upper developer roll 41, when the developer material is carried in a direction against the direction of movement of the drum. The second development takes place adjacent the lower developer roll 42, where the developer material is carried in the same direction as the drum.

During development, the developer material loses a certain proportion of its toner particles. Fresh toner particles are added in the upper regions of housing 23 by rotation of foam roller 22 which drops toner particles onto the carrier particles being transported by the transport roll 43 towards reservoir 58.

In order to contain developer material in housing 23, a magnetic strip seal 77 is provided along the edge of the housing formed by lower extremity 48 of front extrusion 46. A groove or ledge is provided along the edge of extremity 48 to accommodate a magnetic strip of suitable cross section, for example of rectangular or triangular cross section. The magnetic strip may be a flexible strip of a ferrite material, and the desired length of strip may be secured by adhesive into the groove or ledge in extremity 48. The magnetic poles of magnetic strip 77 are arranged so that its face adjacent to the photoconductive surface is of one polarity, that polarity being selected to repel carrier granules being carried toward it by the upper developer roll 41. A similar magnetic strip seal (not shown) may be provided along the edge of the housing formed by the left-hand extremity 47 of the lower extrusion 45.

Without a magnetic strip seal, carrier particles carried by the upper developer roll 41, especially those being carried on the outside extremity of the magnetic brush, have a ratio of radial to tangential forces acting on them which is such that some of these are projected toward the small gap which necessarily exists between the imaging surface and the lower extremity 48 of the upper part of the housing. In the absence of anything to stop them, some of the carrier particles projected toward the gap will escape through it. The magnetic strip seal appears to modify the ratio of the radial to tangential forces acting on the carrier particles such that the carrier particles in the vicinity of the magnetic strip are all carried with the magnetic brush rather than being projected away from it. This seems to be because the magnetic field lines of the nearest pole of the magnetic brush developer roll are modified by the magnetic field of the magnetic strip so as to deflect them away from the gap. This contains the carrier particles inside the housing, without causing them to adhere magnetically to the magnetic strip.

Mounted on top of the housing 23 (FIG. 2) to the right of the toner hopper 21 is the negative pressure chamber housing 49. An outlet 63 on the top of this chamber is connected by a tube to a vacuum system which creates a small negative pressure inside the developer housing. This causes a general flow of air from the region of the drum into the housing, which prevents the emission of clouds of toner from the housing, and reduces contamination in the machine.

Toner housing 21 (FIG. 2) is a relatively tall, narrow container with a generally horizontal lid 64 in its top face. Lid 64 is accessible from the top of the machine. Housing 21 is shaped so as to fit around the right-hand part of the optical system of the machine with its lower extremity being shaped to accommodate foam roll 22. The neck of the hopper is arranged to slightly pinch the foam roller so as to assist in dislodging toner from the roller, and drop it into the housing 23. A stirrer 65 is mounted just above roller 22 to assist the flow of toner within hopper 21 to roller 22.

Crossmixer 44 is located between valance 60 and lower extension 45 of housing 23. The lowermost part of the crossmixer is adjacent the developer take-up region 56. The crossmixer has three parallel rows of chambers; a front row 71 closest to the developer rolls, a middle row 72, and a rear row 73 furthest from the developer rolls. The three rows of chambers are formed by sets of vanes projecting from dividing walls. The crossmixer is made from two component parts, which are aluminum alloy castings. The front casting 74 (nearest the developer rolls) has vanes projecting from both faces of a plate 75, while the rear casting 76 consists of a plate 77 with vanes projecting only from its rear face. The vanes on both castings are shaped so that the forward-projecting vanes of the front casting abut the valance 60, and its rearward-projecting vanes abut the plate 77 of the rear casting. The rearward-projecting vane of the rear casting abut the inside face of the lower extrusion 45 of housing 23. In this way, the three rows of chambers are formed between the valance 60 and the lower extrusion 45, the rows being divided from one another by plates 75 and 77, and the chambers being divided from one another by the vanes projecting from the plates 75 and 77.

The chambers formed by the vanes on the front and rear castings each having an entrance aperture at the top, and an exit aperture at the bottom, the exit aperture in every case being displaced either to the left or to the right of a line vertically below the entrance aperture. These chambers are the main flow chambers for the passage of developer material through the device, as will be further described below. The chambers are grouped in pairs, and between one pair of chambers and the next pair, the vanes also define open topped hoppers which are provided with small exit apertures in their lowermost parts. In this way, the main flow of developer material through the crossmixer takes place through the main flow chambers, with a much smaller subsidiary flow through the intervening hoppers.

In each row of chambers, alternate chambers direct the developer material to the left or to the right of their entrance apertures. Thus, in any given row, a given small volume of developer material entering one of the chambers will be displaced either to the left or to the right during its downward passage through the crossmixer. On recirculation by the magnetic brush rolls to the top of the device, by a substantially vertical movement, a small volume of developer material will re-enter the top of the crossmixer displaced either to the left or to the right of its position during its first passage. In addition, the main flow chambers are so arranged that on successive recirculations, developer material is also shifted from row to row, as will appear from the following description.

Figure 4:
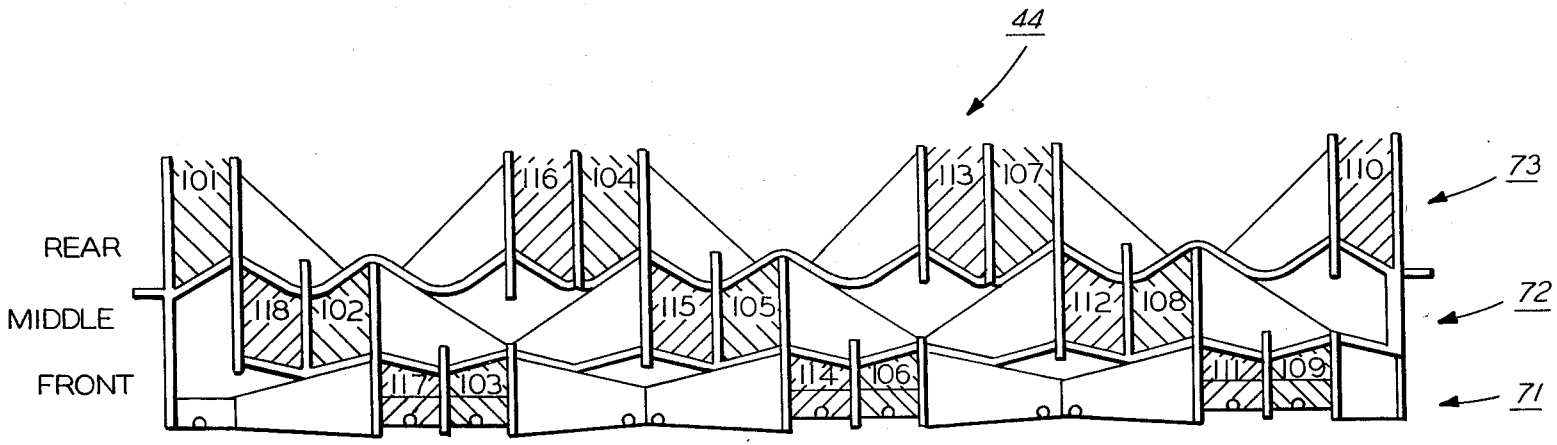
FIG. 4 is a plan view of the crossmixing device used in the FIG. 2 development apparatus.
Figure 5:
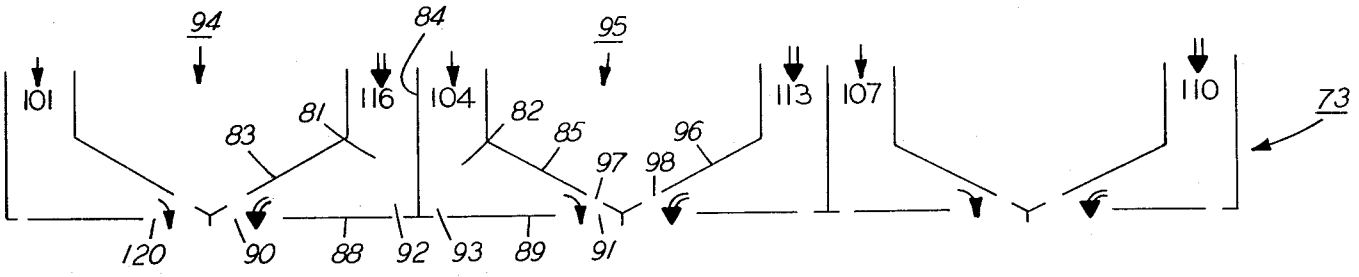
FIG. 5 is a schematic, sectional view of the rear rows of chambers of the FIG. 4 crossmixer, as viewed from the front of the developer housing.
Figure 8:
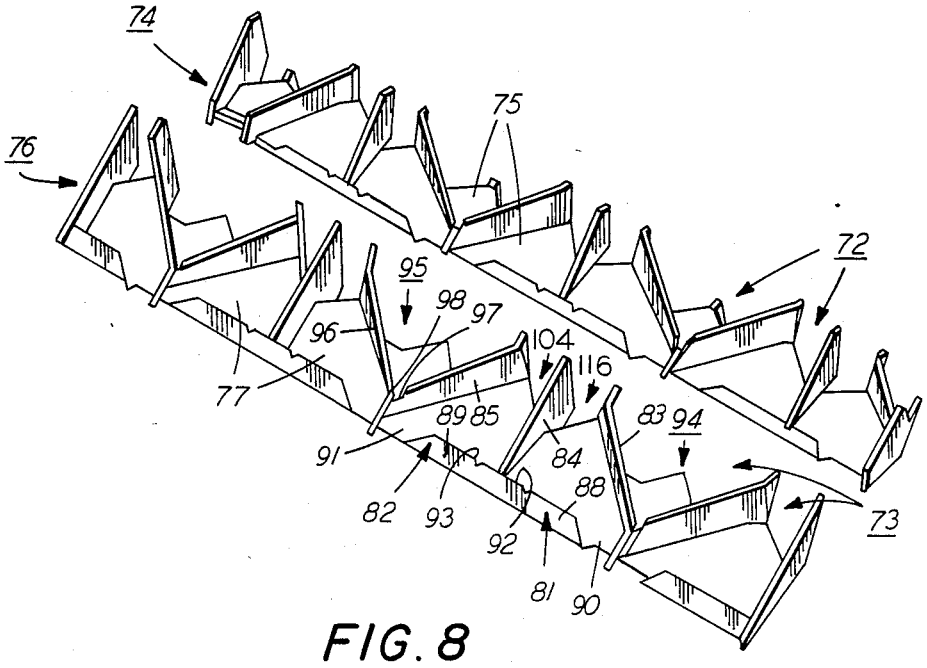
FIG. 8 is a perspective view of the two component parts of the FIG. 4 crossmixer, separated from each other, as viewed from the rear of the developer housing.
Figure 9:
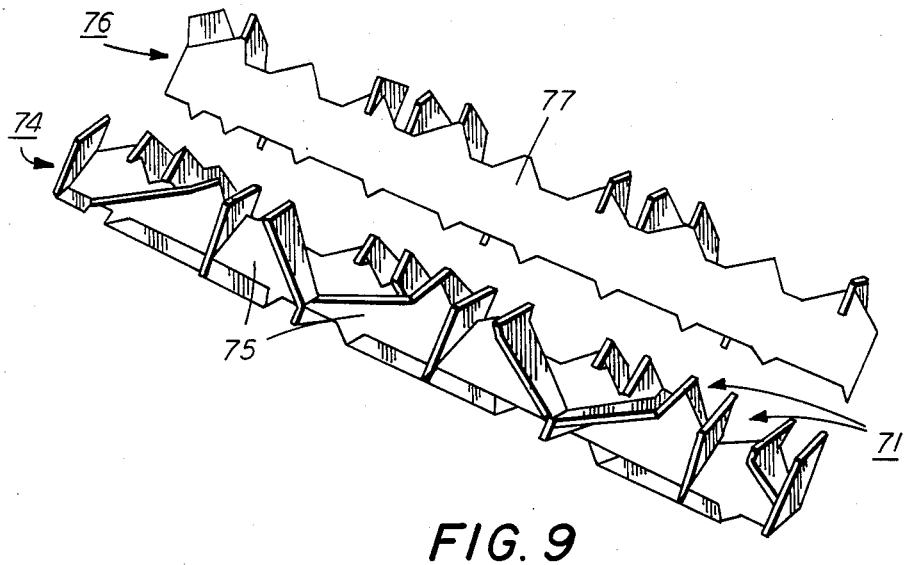
FIG. 9 is a perspective view of the two component parts shown in FIG. 8, as viewed from the front of the developer housing.

For an example of the arrangement of chambers and hoppers, reference will be made to FIGS. 4, 5 and 8, and in particular to the central part of the rear row of chambers. The diagrammatic representation of the vanes shown in FIG. 5 corresponds with the view of the rear casting 76 seen as the lower of the two castings depicted in FIG. 8. However, the diagram of FIG. 5 represents a sectional view seen from the front of the developer housing, whereas the FIG. 8 view is seen from the rear. Chambers 81 and 82 are formed between sloping vane 83 and vertical vane 84, and between vertical vane 84 and sloping vane 85, respectively. Entrance aperture 116 of chamber 81 is formed by the upper edges of vanes 83 and 84, as well as by the plate 77 and lower extrusion 45 of the housing. Similarly, entrance aperture 104 of chamber 82, is formed by the upper edges of vanes 84 and 85, as well as by plate 77 and lower extrusion 45. The bottoms of chambers 81 and 82 are formed by generally horizontal vanes 88 and 89, in the main exit aperture 90 of chamber 81 being formed in a position displaced to the left (as seen in FIG. 5) of a position vertically below entrance aperture 116. Similarly, the main exit aperture 91 of chamber 82 is formed in a position displaced to the right of a position vertically below entrance aperture 104. Developer material entering entrance aperture 116 of chamber 81 accordingly leaves the chamber through exit aperture 90, constituting a main flow path for the developer material. In order to prevent the formation of a static volume of developer material in the chambers, small exit apertures 92 and 93 are formed in the horizontal vanes 88 and 89 respectively, close to the vertical vane 84.

The vanes 83 and 85, as well as forming walls of the main flow chambers 81 and 82, also form the sloping floors of hoppers 94 and 95. The other sloping floors of each hopper are formed by the sloping vanes of the next main flow chambers, such as vane 96. In order to prevent the occurrence of a static volume of developer material in the hoppers, small exit apertures such as apertures 97, 98 are formed on either side of the lowest part of the hopper, just above the exit apertures of the main flow chambers.

Figure 6:
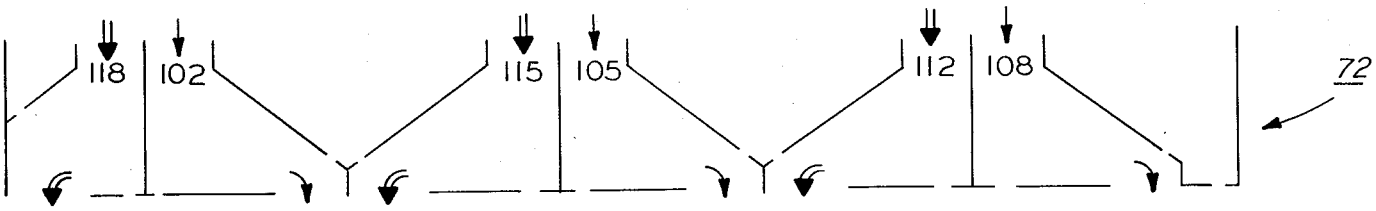
FIG. 6 is a schematic, sectional view of the middle rows of chambers of the FIG. 4 crossmixer, as viewed from the front of the developer housing.
Figure 7:
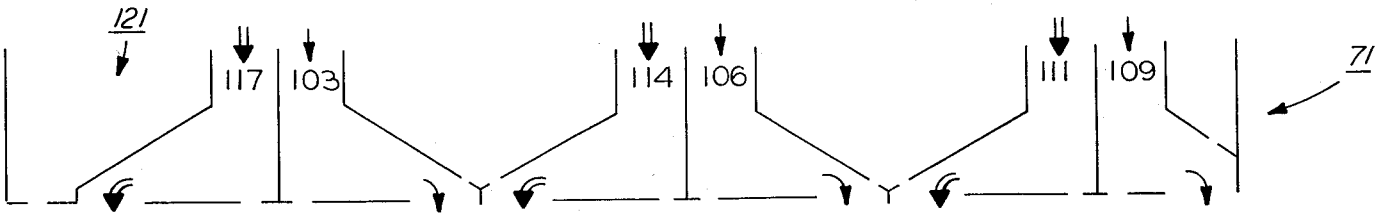
FIG. 7 is a schematic, sectional view of the front rows of chambers of the FIG. 4 crossmixer, as viewed from the front of the developer housing.

In order to explain how the crossmixer achieves a thorough mixing of developer material, the journey of a small sample volume of developer material will now be traced through a complete cycle. For ease of understanding, the successive entrance apertures of the crossmixer chambers encountered by the sample volume have been numbered consecutively in FIGS. 4, 5, 6 and 7, starting at 101 and finishing at 118. Turning first to FIGS. 4 and 5, the start point is taken to be the entrance aperture 101 at the entreme left of the rear row. Developer material falls through this first chamber, and leaves it by the exit aperture 120 at the bottom of the crossmixer. In passing through the crossmixer, by way of this first chamber, the developer material has been shifted to the right. The developer material is then recirculated by being carried vertically upwards by the magnetic brush rolls as described above, to be reintroduced into the crossmixer directly above the exit aperture 120. The developer material accordingly falls partly into hopper 94 of the rear row, partly into entrance aperture 102 (FIG. 6) of the middle row, and partly into hopper 121 of the front row. Hoppers 94 and 121 have only small exit apertures, and so maintain slow-flowing reservoirs of developer material. The main flow route at this point is provided by the chamber in the middle row which has entrance aperture 102.

Upon the next recirculation, developer material falls into the crossmixer displaced to the right of entrance aperture 102, i.e. in a position corresponding with entrance aperture 103 (FIG. 7) of the front row. Once again, developer material which falls into the hoppers of the rear and middle rows at this point forms a very minor part of the flow, with most of the flow taking place through entrance aperture 103. The next recirculation produces a main flow through entrance aperture 105 (middle row), 106 (front row), 107 (rear row), 108 (middle row) and 109 (front row). Entrance aperture 109 is the last entrance aperture which causes developer material movement to the right, and upon recirculation at this position (i.e. at the right of the crossmixer) developer material enters entrance aperture 110 at the extreme right of the rear row. The next main flow entrance aperture is entrance aperture 111 in the front row, and successive recirculations continue the movement to the left, by way of entrance aperture 112 (middle row), 113 (rear row), 114 (front row), 115 (middle row), 116 (rear row), 117 (front row) and 118 (middle row). After passing through the left-hand end chamber of the middle row (entrance aperture 118), the developer material is once again in position for recirculation and re-entry into entrance aperture 101 to repeat the cycle. As will be clear, developer material is passing through all of the entrance apertures at any one time, causing simultaneous movement of developer material from left to right and from row to row, and from right to left and from row to row of the crossmixer.

This crossmixer thoroughly mixes the developer material, without any tendency to produce imbalances of any kind. The entire crossmixer is kept full of developer material at all times, with flow being produced as a result of demand for developer material in the take-up region 56 at the bottom of the crossmixer. Although the crossmixer has been described as having three rows of chambers, it is clear that the same mixing principles can be applied to a crossmixer having two or more rows of chambers.

The volume taken up by the material which forms the crossmixer is minimal, there being no cavity or chamber inaccessible to the developer material, and all the walls of the crossmixer castings being of relatively small thickness. This enables a maximum quantity of developer material to reside in the development apparatus, thereby reducing wear and tear on each carrier particle and prolonging the useful working life of the developer material.

It is, therefore, evident that there has been provided in accordance with the present invention, a crossmixer that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for mixing flowing developer material, including:

at least one dividing plate; and a plurality of spaced vanes projecting outwardly from said dividing plate, said vanes and said dividing plate defining a plurality of sets of chambers arranged in substantially parallel rows with each chamber being arranged to receive developer material at an entrance aperture and to release the developer material from an exit aperture, each chamber having its exit aperture displaced from a position vertically below its entrance aperture, each row having an alternate series of chambers with their exit apertures spaced respectively to the left and right of the position vertically below their entrance apertures and the entrance apertures and exit apertures of the chambers of different rows being aligned so that on successive recirculations of the developer material the developer material moves simultaneously from left to right and from row to row, and from right to left and from row to row.

2. An apparatus according to claim 1, wherein an elemental volume of developer material is moved systematically during each successive recirculation so as to move from one end of the apparatus to the other end during a predetermined number of recirculations and back to said one end during the next following same number of recirculations.

3. An apparatus according to claim 2, wherein said plate and said plurality of vanes projecting outwardly therefrom define three rows of chambers.

4. An apparatus according to claim 2, wherein the chambers defined by said plate and said plurality of vanes are grouped in pairs with two chambers of each pair having their exit apertures spaced in opposite directions from their entrance apertures.

5. An apparatus according to claim 4, further including a plurality of hoppers with one of said plurality of hoppers being positioned between successive pairs of chambers and the chambers forming the main passageway for the flowing developer material, each of said plurality of hoppers having smaller apertures than the exit apertures to provide a subsidiary, slower moving flow of developer material.

6. An apparatus according to claim 5, further including a housing encompassing said plate and said plurality of vanes so that all the developer material entering said housing passes through the chambers therein.

7. An apparatus according to claim 6, wherein said housing is arranged to maintain said plate and said plurality of vanes submerged in developer material.

8. An apparatus according to claim 1, further including:

a second dividing plate; and a plurality of vanes projecting outwardly from opposed surfaces of said second dividing plate, said second dividing plate being positioned adjacent said first dividing plate so as to define three rows of chambers.

* * * * *